US008970096B2

(12) United States Patent
Unger et al.

(10) Patent No.: US 8,970,096 B2
(45) Date of Patent: Mar. 3, 2015

(54) ANTI-FOULING SPARK PLUG AND METHOD OF MAKING

(75) Inventors: Peter Unger, Morristown, NJ (US); Ron Rohrbach, Flemington, NJ (US); Jeff Boehler, Holland, OH (US); Jing Zheng, Findlay, OH (US)

(73) Assignee: Fram Group IP LLC, Lake Forest, IL (US)

( * ) Notice: Subject to any disclaimer, the term of this patent is extended or adjusted under 35 U.S.C. 154(b) by 86 days.

(21) Appl. No.: 13/312,342

(22) Filed: Dec. 6, 2011

(65) Prior Publication Data

US 2012/0139405 A1 Jun. 7, 2012

Related U.S. Application Data

(60) Provisional application No. 61/420,072, filed on Dec. 6, 2010.

(51) Int. Cl.

| | |
|---|---|
| ***H01T 13/20*** | (2006.01) |
| ***H01T 13/38*** | (2006.01) |
| ***H01T 13/14*** | (2006.01) |
| ***H01T 21/02*** | (2006.01) |
| ***C23C 18/12*** | (2006.01) |

(52) U.S. Cl.

CPC ..... *H01T 13/14* (2013.01); *H01T 13/38* (2013.01); *H01T 13/20* (2013.01); *H01T 21/02* (2013.01); *C23C 18/1216* (2013.01); *C23C 18/1283* (2013.01)

USPC ..... 313/118

(58) Field of Classification Search

CPC ..... H01T 13/14; H01T 13/20; H01T 13/38

USPC ..... 123/169 CL; 313/118, 127, 130, 131 R, 313/131 A, 137, 144; 333/169 CL

See application file for complete search history.

(56) References Cited

U.S. PATENT DOCUMENTS

| | | | | |
|---|---|---|---|---|
| 4,092,264 | A | 5/1978 | Tsang et al. | |
| 4,250,426 | A * | 2/1981 | Nakajima et al. | 313/143 |
| 4,267,483 | A | 5/1981 | Nakajima et al. | |

(Continued)

OTHER PUBLICATIONS

International Preliminary Report on Patentability of PCT/US2011/063528 dated Jun. 12, 2013.

(Continued)

*Primary Examiner* — Andrew Coughlin
*Assistant Examiner* — Steven Horikoshi
(74) *Attorney, Agent, or Firm* — Erin J. Fox; Barnes & Thornburg LLP

(57) ABSTRACT

Disclosed herein is a spark plug comprising an insulative sleeve having a central axial bore and an exterior surface and a center electrode extending through the central axial bore of the insulative sleeve. The insulating sleeve is positioned within, and secured to, a metal shell that serves as a mounting platform and interface to an internal combustion engine. The metal sleeve also supports a ground electrode that is positioned in a spaced relationship relative to the center electrode so as to generate a spark gap. The insulating sleeve includes a shaped tip portion that resides in a recessed end portion of the metal shell. A coating is disposed on the exterior surface of the shaped tip portion of the insulative sleeve. The coating comprises a metal oxide, a noble metal, late transition metal, or a combination comprising two or more of the foregoing metals.

8 Claims, 2 Drawing Sheets

(56) References Cited

U.S. PATENT DOCUMENTS

| | | | | |
|---|---|---|---|---|
| 4,415,828 | A | 11/1983 | Mizuno et al. | |
| 4,972,811 | A * | 11/1990 | Baresel et al. | 123/143 B |
| 5,109,178 | A | 4/1992 | Yoshida et al. | |
| 5,274,298 | A | 12/1993 | Cassidy et al. | |
| 5,550,424 | A * | 8/1996 | Jennrich et al. | 313/130 |
| 5,952,769 | A * | 9/1999 | Budaragin | 313/141 |
| 6,051,529 | A | 4/2000 | Brezny | |
| 6,060,821 | A | 5/2000 | Suzuki et al. | |
| 6,090,191 | A | 7/2000 | Atlanova et al. | |
| 6,548,944 | B1 | 4/2003 | Morita | |
| 6,589,900 | B1 | 7/2003 | Kotze | |
| 6,858,975 | B1 | 2/2005 | Matsutani | |
| 6,888,293 | B2 | 5/2005 | Roessler et al. | |
| 2003/0122462 | A1 * | 7/2003 | Nishikawa et al. | 313/143 |
| 2007/0188063 | A1 * | 8/2007 | Lykowski | 313/137 |

OTHER PUBLICATIONS

Kling et al., Ignition Devices, e.g., "Spark Plugs, Hot Plugs, and the Like, Consisting of a Ceramic or Metallic Base and Whose Tip is Coated with an Oxide, and Their Manufacture," *Chemical Abstracts*, vol. 117, No. 8, Sec. 157, Abstract No. 0705045.

Ooshima, "Durable Spark Plugs with Metal Oxide-Treated Tips," *Chemical Abstracts*, vol. 105, No. 26, Sec. 156, Abstract No. 231052w.

Office Action issued in Chinese Application No. 201180057757.9 on Jul. 14, 2014.

* cited by examiner

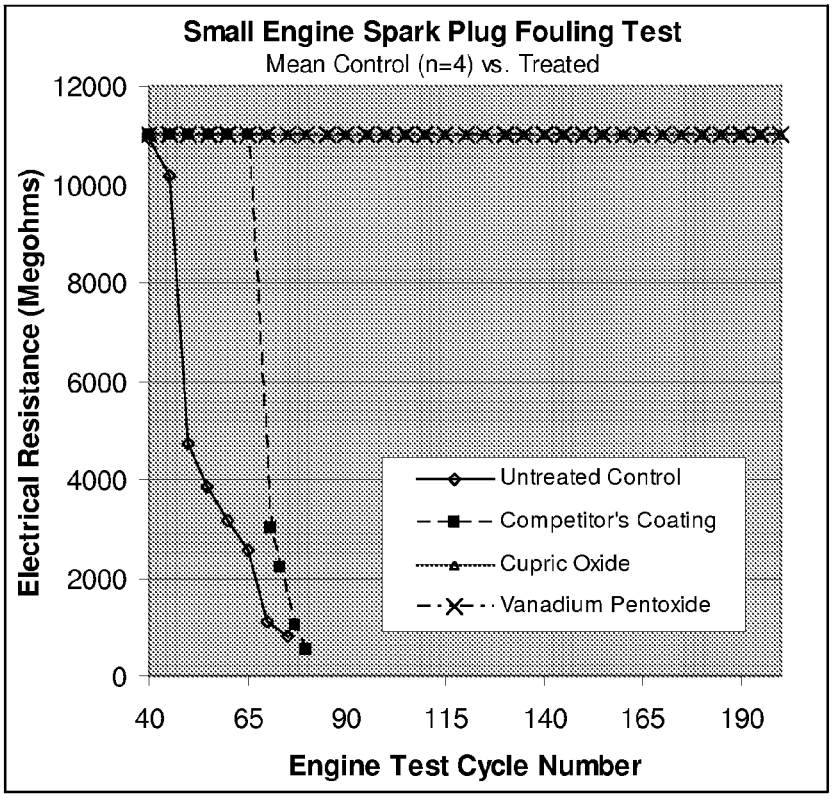
Figure 2. Small engine test results showing effect of various coatings on soot fouling resistance.

ANTI-FOULING SPARK PLUG AND METHOD OF MAKING

CROSS REFERENCE TO RELATED APPLICATIONS

This application claims the benefit of U.S. Provisional Patent Application No. 61/420,072 filed on Dec. 6, 2010, which is incorporated by reference herein in its entirety.

BACKGROUND

In general, spark plugs include an insulative sleeve having a central axial bore through which a center electrode extends. The insulating sleeve is positioned within, and secured to, a metal shell that serves as a mounting platform and interface to an internal combustion engine. The metal sleeve also supports a ground electrode that is positioned in a particular spaced relationship relative to the center electrode so as to generate a spark gap. The insulating sleeve includes a shaped tip portion that resides in a recessed end portion of the metal shell. The shaped tip portion is configured to protect the electrode from engine heat and products of combustion. The spark plug is typically mounted to an engine cylinder head and selectively activated to ignite a fuel/air mixture in an associated engine cylinder.

Over time, products of combustion or combustion deposits build up around the center electrode and particularly the shaped tip portion. This build up of combustion product inhibits spark formation across the spark gap. A significant build up of combustion products may foul the spark plug and resulting in ignition failure, i.e., the combustion products completely block the spark from forming between the center and ground electrodes. Combustion deposit build up is particularly problematic during cold starts. During cold starts, complete combustion of the air/fuel mixture is seldom achieved which results in an increased generation of electrically conductive combustion deposits. As a result of continuous cold starts, electrically conductive combustion deposits build up resulting in an electrical short circuit between the center electrode and the electrically grounded portion of the spark plug.

Previous attempts to address combustion deposit build up issues have included silicone oil coatings and particulate vanadium oxide deposition on the insulating sleeve. These coatings have failed to adequately address the issue, suffering from inadequate performance at elevated temperature, inadequate endurance, or insufficient reduction of combustion deposit build up.

Accordingly, there is a need for a spark plug which has a decreased susceptibility to electrically conductive combustion deposit build up in the insulative sleeve.

BRIEF DESCRIPTION

Disclosed herein is a spark plug comprising an insulative sleeve having a central axial bore and an exterior surface and a center electrode extending through the central axial bore of the insulative sleeve. The insulative sleeve is positioned within, and secured to, a metal shell that serves as a mounting platform and interface to an internal combustion engine. The metal sleeve also supports a ground electrode that is positioned in a spaced relationship relative to the center electrode so as to generate a spark gap. The insulating sleeve includes a shaped tip portion that resides in a recessed end portion of the metal shell. A coating is disposed on a portion of the exterior surface of the shaped tip portion of the insulative sleeve. The coating comprises a metal oxide, a combination of metal oxides, a noble metal, a late transition metal, or a combination of two or more of the foregoing metals.

Also disclosed herein are methods of making the coated insulative sleeve and a spark plug comprising the coated insulative sleeve.

BRIEF DESCRIPTION OF THE DRAWING

FIG. 2 is a graph showing the results of a small engine spark plug test.

DETAILED DESCRIPTION

Figure 1:
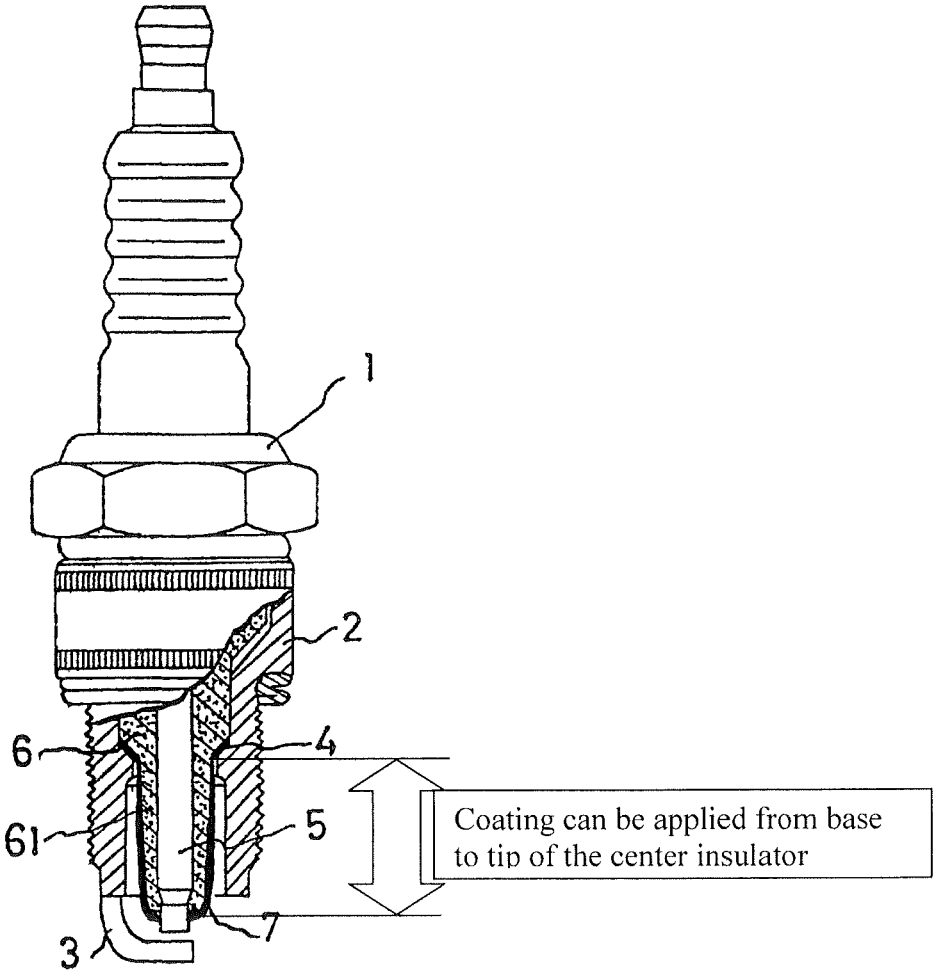
FIG. 1 is a side view of a spark plug, partly shown in cross section.

The coating comprising a metal oxide, as described herein, is a substantially continuous coating. A substantially continuous coating, as defined herein, describes a coating which is has no breaks or gaps visible to the naked eye and covers a portion of shaped tip portion the exterior surface of the insulative sleeve.

The coating thickness can be 1 to 20 micrometers in thickness, or, more specifically 5 to 15 micrometers in thickness.

Suitable metal oxides include barium oxide, copper (II) oxide, manganese oxide, vanadium pentoxide, zinc oxide, zirconium oxide, cerium oxide, molybdenum trioxide, bismuth oxide, tungsten oxide, chromium trioxide, iron (III) oxide, cobalt oxide, nickel (II) oxide, titanium dioxide (anatase), tin oxide, and combinations of two or more of the foregoing metal oxides. Exemplary combinations of metal oxides include cerium oxide and vanadium oxide, vanadium oxide and zirconium oxide, as well as copper (II) oxide and vanadium oxide.

Surprisingly it has been found that the metal oxide coatings described above are not sufficiently conductive, at the thicknesses described herein, to interfere with the operation of the spark plug. Without being bound by theory it is speculated that the metal oxide coating may function as a catalyst to facilitate combustion either during a cold start or during subsequent operation, thus reducing or removing the combustion deposit build up. Alternatively, the metal oxide may absorb oxygen which it can then provide during combustion at the interface of the insulative sleeve and the combustion products, thus facilitating more complete combustion.

Suitable noble or late transition metals include platinum, palladium, gold, silver, ruthenium, rhodium, iridium, and combinations thereof. Without being bound by theory it is speculated that the noble metal or late transition metal coating may function as a catalyst to facilitate combustion either during a cold start or during subsequent operation, thus reducing or removing the combustion deposit build up.

The coating is formed on the insulative sleeve by forming a slurry or solution of the metal oxide, a metal oxide precursor, noble metal or combination thereof. The slurry or solution is applied to the insulative sleeve by any appropriate method such as painting, dip coating, spray coating and the like. In some embodiments the slurry is an aqueous slurry. The particles used to form the slurry can have an average particle size of 10 to 100 nanometers. In some embodiments the metal oxide particles have a maximum particle size of less than or equal to 125 micrometers. The slurry or solution can comprise up to 25 weight percent of the particles, based on the total weight of the slurry. Within this range the amount of particles in the slurry or solution can be 0.5 to 10 weight percent, or, more specifically, 2.5 to 5 weight percent.

The applied slurry or solution is allowed to air dry at room temperature to form a coated insulative sleeve. The coated insulative sleeve is then treated at an elevated temperature, such as 70 to 150 degrees C. for 30 minutes to 60 hours. The coated insulative sleeve is then calcined at a temperature of 750 to 950 degrees C. for a period of 30 minutes to several hours. Within this range the calcination time can be 30 minutes to 1.5 hours. The calcined insulative sleeve is then allowed to cool and the spark plug assembled.

An exemplary spark plug is shown in FIG. 1. The spark plug, 1, has a metal shell, 2, a ground electrode, 3, a center electrode, 5, an insulative sleeve, 6, a shaped tip portion of the insulative sleeve, 61, and a coating, 7, disposed on the insulative sleeve. The longitudinal extent of the coating (from center electrode to metal shell) can vary Importantly, the coating should form a continuous coating around the circumference of the insulative sleeve in at least one location.

The invention is further illustrated by the following non-limiting examples.

Several metal oxides were screened for conductivity, adherence to the insulative sleeve and impact on combustion deposit accumulation/removal using the following procedure. An aqueous slurry of the metal oxide was coated onto an alumina slide, air dried and calcined at 775 degrees C. for 60 minutes. The coated slides were then evaluated for adhesion to the alumina and resistivity. Resistivity was measured using a Fluke 1507 Megohmmeter. Higher resistance means less conductivity.

| Formula | m.p. (C.) | Characteristics after 775 C. Firing | Electrical resistance |
|---|---|---|---|
| BaO | 1923 | Sticks well | >11 Gigohms |
| CuO | 1201 | Sticks well | >11 Gigohms |
| $MnO_2$ | 535 (decomp.) | Some rubs off in thicker areas | >11 Gigohms |
| $SnO_2$ | 1630 | Sticks well- shiny surface? | 7.4 Gigohms |
| $TiO_2$ | 1843 | Some rubs off- shiny surface? | 7.6 Gigohms |
| $V_2O_5$ | 690 | Sticks well | >11 Gigohms |
| ZnO | 1975 | Sticks well | >11 Gigohms |
| $ZrO_2$ | 2715 | Easily rubs off | >11 Gigohms |
| $CeO_2$ | 2400 | Easily rubs off | >11 Gigohms |
| $CeO_2 + V_2O_5$ | n/a | Sticks | >11 Gigohms |
| $CuO + V_2O_5$ | n/a | Sticks well | >11 Gigohms |
| $ZrO_2 + V_2O_5$ | n/a | Sticks well | >11 Gigohms |
| $MnO_2 + V_2O_5$ | n/a | Some color rubs off | >11 Gigohms |

Copper (II) oxide and vanadium oxide were coated onto insulative sleeves using the following procedures.

Cupric Oxide (CuO)

Copper oxide [cupric oxide, copper (II) oxide, copper monoxide] was obtained from Nanophase Technologies Corporation. The material was supplied as a very finely divided dry powder, with an average particle size of 33 nm. The surface area was about 29 $m^2/g$.

An aqueous slurry containing 5 percent by weight, based on the total weight of the slurry, of the cupric oxide powder was prepared, and allowed to stir at room temperature for at least 16 hours at room temperature to fully wet and disperse the material.

The tip of spark plug bare insulators which were to be exposed to the combustion chamber were dip coated in the aqueous cupric oxide slurry as follows:

1. The portion of the insulator requiring the cupric oxide treatment was submerged in the cupric oxide slurry
2. After the tip became thoroughly wetted with the cupric oxide suspension, it was drawn upward out of the suspension at a medium rate (~1 second)
3. The wetted tips were then allowed to dry under airflow [face velocity of about 100 feet per minute (FPM)] at room temperature for 4 to 16 hours.
4. The air dried tips were then heated in a convection oven at 120° C. for 4 to 16 hours.
5. The coated tips were then calcined in a muffle furnace to a temperature of 775 to 950° C. for a period of one hour.
6. The coated insulator was then used to construct a completed spark plug.

Vanadium Pentoxide ($V_2O_5$)

Vanadium pentoxide [vanadium (V) oxide, vanadic anhydride, divanadium pentoxide] was obtained from Alfa Aesar as a powder. The powder as supplied was further reduced in particle size by hand-milling with a mortar and pestle. The estimated particle size was less than 120 mesh (125 micrometers).

An aqueous slurry containing 5 percent by weight of the vanadium pentoxide powder was prepared, and allowed to stir at room temperature for at least 16 hours at room temperature to fully wet and disperse the material.

The tip of spark plug bare insulators which will be exposed to the combustion chamber was dip coated in the aqueous cupric oxide slurry as follows:

1. The portion of the insulator requiring the vanadium pentoxide treatment was submerged in the vanadium pentoxide slurry
2. After the tip became thoroughly wetted with the vanadium pentoxide suspension, it was drawn upward out of the suspension at a medium rate (~1 second)
3. The wetted tips were then allowed to dry under airflow [face velocity about 100 FPM] at room temperature for 4 to 16 hours.
4. The air dried tips were then heated in a convection oven at 120° C. for 4 to 16 hours.
5. The coated tips were then calcined in a muffle furnace to a temperature of 775° C. to 950° C. for a period of one hour.
6. The coated insulator was then used to construct a completed spark plug.

The spark plugs coated with vanadium oxide and copper (II) oxide were tested for performance in a small engine (a 5 horsepower engine from a Tecumseh wood chipper). The testing was conducted in open air test area using outdoor ambient conditions (25-90+° F., uncontrolled humidity). The engine was run predominantly fuel rich. The engine ran for 1-5 minutes, and the cooling period between runs was generally 15 minutes. Shunt resistance was measured after every run cycle. Results are shown in FIG. 2.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

All ranges disclosed herein are inclusive of the endpoints, and the endpoints are combinable with each other.

All cited patents, patent applications, and other references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another.

The invention claimed is:

1. A spark plug comprising an insulative sleeve having a central axial bore and an exterior surface of a shaped tip portion, wherein a coating is disposed on the exterior surface of the shaped tip portion and the coating consisting essentially of vanadium oxide, wherein the coating is a continuous coating around a circumference of the insulative sleeve and the coating has thickness between about 1 and about 20 micrometers;

a center electrode extending through the central axial bore of the insulative sleeve;

a metal shell, wherein the insulative sleeve is positioned within, and secured to, the metal shell; and a ground electrode supported by the metal shell and positioned in a spaced relationship relative to the center electrode so as to generate a spark gap.

2. The spark plug of claim 1, wherein the coating is formed by applying a slurry to the insulative sleeve, wherein the slurry comprises particles having a maximum particle size of less than or equal to 125 micrometers.

3. The spark plug of claim 2, wherein the particles have an average size of 10 to 100 nanometers.

4. The spark plug of claim 1, wherein the coating extends between a base and a tip of the insulative sleeve.

5. The spark plug of claim 1, wherein the coating has a thickness of between about 5 and about 15 micrometers.

6. The spark plug of claim 1, wherein the coating is formed by applying a slurry to the insulative sleeve, wherein the slurry comprises vanadium oxide up to about 25 percent by weight of the coating.

7. The spark plug of claim 6, wherein the vanadium oxide forms between about 0.5 and about 10 percent by weight of the slurry.

8. The spark plug of claim 7, wherein the vanadium oxide forms between about 2.5 and about 5 percent by weight of the slurry.

* * * * *